United States Patent [19]

Hunt

[11] 4,309,832

[45] Jan. 12, 1982

[54] ARTICULATED SHOE SOLE

[76] Inventor: Helen M. Hunt, Journey's End La., Princeton, N.J. 08540

[21] Appl. No.: 150,568

[22] Filed: May 16, 1980

Related U.S. Application Data

[63] Continuation-in-part of Ser. No. 134,651, Mar. 27, 1980.

[51] Int. Cl.[3] ..... A43B 13/04; A43B 13/08; A43B 13/14

[52] U.S. Cl. ..... 36/32 R; 36/31; 36/33

[58] Field of Search ..... 36/32 R, 33, 13, 31; 12/142 MC

[56] References Cited

U.S. PATENT DOCUMENTS

| | | | |
|---|---|---|---|
| 2,352,532 | 6/1944 | Ghez et al. | 36/33 |
| 4,130,947 | 12/1978 | Denu | 36/32 R |
| 4,213,255 | 7/1980 | Olberz et al. | 36/32 R |
| 4,262,435 | 4/1981 | Block et al. | 36/31 |

*Primary Examiner*—P. D. Lawson
*Attorney, Agent, or Firm*—Richard C. Woodbridge

[57] ABSTRACT

A flexible shoe, preferably of the sport shoe variety, includes a resilient sole which incorporates one or two transverse hinge joints. The principal hinge joint extends across the ball of the foot and preferably passes under the first metatarso-phalangeal joint. An optional second hinge joint extends across the anterior heel region of the foot. Both hinge joints function to keep the effective sole levers short and thereby permit the foot to function in a natural and comfortable manner. The shank of the sole may be longitudinally stiffened for additional stability.

2 Claims, 5 Drawing Figures

ARTICULATED SHOE SOLE

CROSS-REFERENCE TO RELATED APPLICATIONS

This application is a continuation-in-part of U.S. application Ser. No. 134,651 filed Mar. 27, 1980 by the inventor of the device described herein and entitled AN ATHLETIC SHOE INCLUDING STIFFENING MEANS FOR SUPPORTING THE REAR PORTION OF THE FIRST METATARSAL BONE.

BACKGROUND OF THE INVENTION

1. Field of the Invention

This invention relates in general to shoes and more specifically to shoes having articulated soles.

2. Description of the Prior Art

Many present day shoes, including a large number of running shoes, do not easily bend longitudinally at the region of the ball of the foot. Adverse consequences are common when such shoes are worn for the purpose of athletic participation or extensive walking. Some common consequences are: (a) strain of the anterior leg, ankle or foot structures; (b) increased likelihood of ankle sprain; (c) over use of posterior leg muscles or tendons; (d) excessive pronation if the leg is weak or tired; (e) heel strain, including heel spurs; and (f) pulling or slipping of shoe on rear part of foot.

Furthermore, some present day shoes are as stiff as a board at the bottom in the region extending from the back of the heel to the metartarsus. If the heel of the shoe is not rounded on the bottom, there is a tendency for the shoe and foot to slap down hard upon heel strike. In consequence, extensive walking or athletic participation may cause strains of the anterior leg, ankle, or foot structures. If on the other hand, the heel of the shoe is adequately rounded to prevent such strain, then calf strain, achilles tendon strain, or heel strain is likely.

Inflexibility as described above is sometimes avoided by making the sole thin or by constructing the sole out of very flexible materials. A common failing of such shoes is that they lack stability. Another failing, most apparent in running shoes, is that if longitudinal flexibility at the ball is good, then shock absorption in that region is unsatisfactory.

It is known to those of ordinary skill in the art that some outer soles have transverse ripples which extend across the ball of the foot for longitudinal flexibility. Such ripples frequently wear rapidly and cannot be maintained conveniently by present methods.

A new outer sole manufactured by the Adidas Company is employed on running shoes identified as models "SL-80" and "Runner Super". That sole is articulated along curved lines in the ball and heel regions. The articulations do not protrude into the midsole of the shoe. The construction principally provides longitudinal sole flexibility under the toes well forward of the ball of the foot.

Several shoes of particular interest are described in the patent literature. In U.S. Pat. No. 3,507,057 issued to Olof Goete Olssen, a wooden shoe having a V-shaped transverse hinge joint situated "directly rearwardly of the ball of the foot" is disclosed. U.S. Pat. No. 4,130,947, issued to Francis Denu, discloses an athletic shoe having a sole comprised of an upper layer and a lower layer. The upper surface of the lower layer conforms to the downwardly projecting transverse ribs of the upper layer. In U.S. Pat. No. 4,030,213 the inventor, Alexander C. Daswick, discloses a sport shoe having a transverse joint located in the region of the shank thereof.

Efforts have been made to improve the flexibility of spiked sport shoes. Methods of possible interest are disclosed in U.S. Pat. No. 3,127,687, issued to Solomon C. Hollister, U.S. Pat. No. 3,341,952 issued to Adolf Dassler, and U.S. Pat. No. 3,487,563 issued to Clive J. Austin.

Two magazine articles of interest were written by Richard Schuster and appeared in the February, 1980 and March, 1980 editions of THE RUNNER. They are entitled respectively "Point of Purchase: 10 Points" and "Evolution of the Running Shoe".

Another feature of the present invention is the use of shank stiffeners in the context of an articulated shoe sole. An extensive history of the prior art that relates to shank stiffeners is presented in my copending application, Ser. No. 134,651 filed on Mar. 27, 1980. Further detailed discussion may be found in the Prior Art Statement filed with that application. The contents of the aforedescribed copending application and Prior Art Statement are hereby incorporated in total by reference into this application.

SUMMARY OF THE INVENTION

Briefly described, the present invention overcomes the problems associated with longitudinal inflexibility in shoe soles. The problems occur especially in thick-soled shoes of various types, including running shoes, hiking shoes, golf shoes and street shoes.

According to the preferred embodiment of the invention, a strong outer sole is molded so that it has at least one transverse hinge joint therein. The outer sole is preferably thin and its hinge joint protrudes into a corresponding groove in a mid-sole layer. The shoe sole as a whole is thus equipped with a durable hinge joint.

The shoe sole includes one transverse hinge joint at the region of the ball of the foot and possibly an additional transverse hinge joint across the anterior heel region. The primary, or forefoot, hinge joint allows for easy bending of the sole. The secondary, or rearfoot, hinge joint allows moderate but not high resistance to bending. These properties of the sole reflect the anatomy and mechanics of the foot.

Additionally, the shoe sole, according to the preferred embodiment of the invention, includes a medial longitudinal shank stiffener to stabilize pronation of the foot. Such a stiffener is recommended because the heel of the foot is typically elevated in the shoe which renders pronation less stable than in the "natural" barefoot state.

These and other features of the invention will be more fully understood with reference to the following drawings and detailed description of the invention.

DETAILED DESCRIPTION OF THE INVENTION

During the course of this description like numbers will be used to indicate like elements according to the different figures which illustrate the invention.

Figure 1:
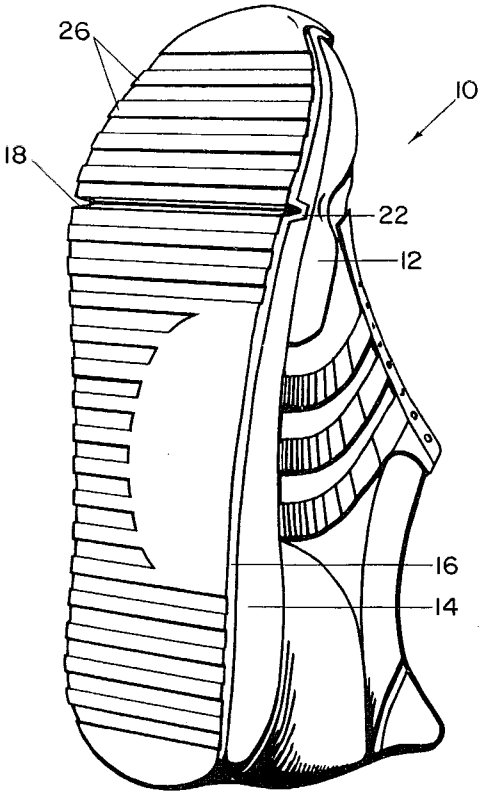
FIG. 1 is a bottom perspective view of the preferred embodiment of the invention illustrating the location of the forefoot transverse hinge joint on an athletic shoe for the right foot.

The invention 10 is illustrated in detail in FIG. 1. The running shoe includes an upper 12, a midsole 14, and an outer sole 16. The outer sole 16 preferably includes treads 26 or similar studs or cleats. Many shoes do not include a midsole 14, but instead have an extra thick outer sole 16. In that case, the present invention would be modified so that the outer sole 16 and midsole 14 are combined into one larger thick outer sole 16.

Figure 2:
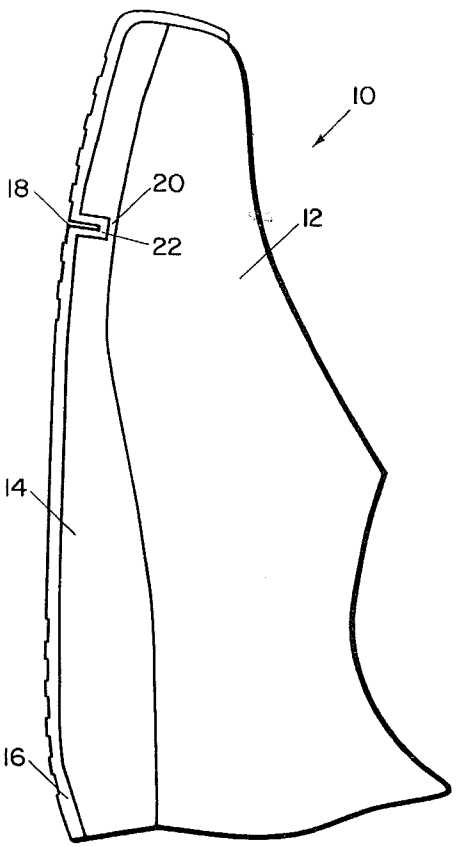
FIG. 2 is a profile view of the preferred embodiment of FIG. 1.
Figure 4:
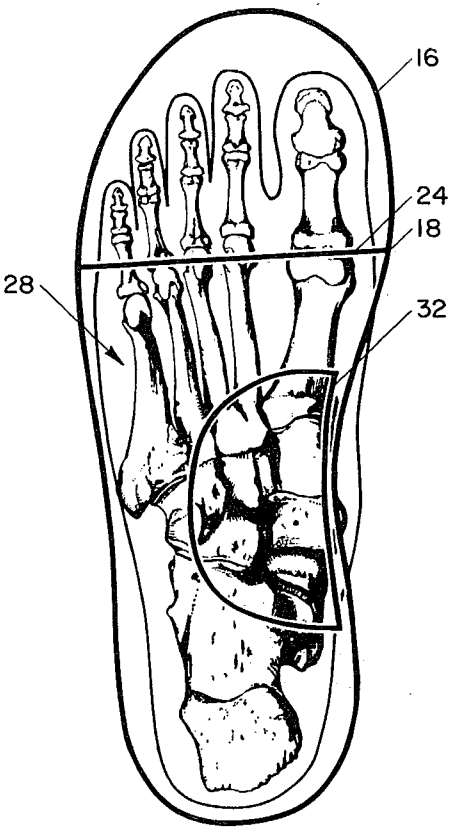
FIG. 4 is a plantar (i.e. bottom) projection of the bones and exterior of the right foot and their relationship to the shape of the shoe and a medial shank stiffener which may be used therewith.

A hinge joint 18 according to the preferred embodiment is illustrated in FIGS. 1 and 2. Hinge joint 18 extends substantially transversely across the complete width of the ball region of the foot, and preferably passes substantially under the region of the first metatarso-phalangeal joint 24 of the foot 28 as shown in FIG. 4. Hinge joint 18 is preferably transverse, but can vary to within 15° or preferably 10° off of the transverse axis of the sole 16. The transverse axis is definable as a line substantially transverse to the long major axis of the sole. The definition of the long major axis of the sole or foot may vary slightly in the trade and therefore no specific axis is preferred or illustrated in order to avoid confusion.

The construction of the joint 18 includes a groove 20 which extends entirely across the midsole 14 and a corresponding indentation 22 in the outer sole in combination with the joint 18 in the outer sole as shown in detail in FIG. 2. The outer sole 16 is preferably molded so that at the midsole groove 20 it angles upward and bends down on itself at approximately 180°. For maximum benefit the sole is preferably flexible at least from the hinge joint 18 forward to the tip of the toe and rearward at least far enough to come completely under the head of the first metatarsal bone.

Figure 3:
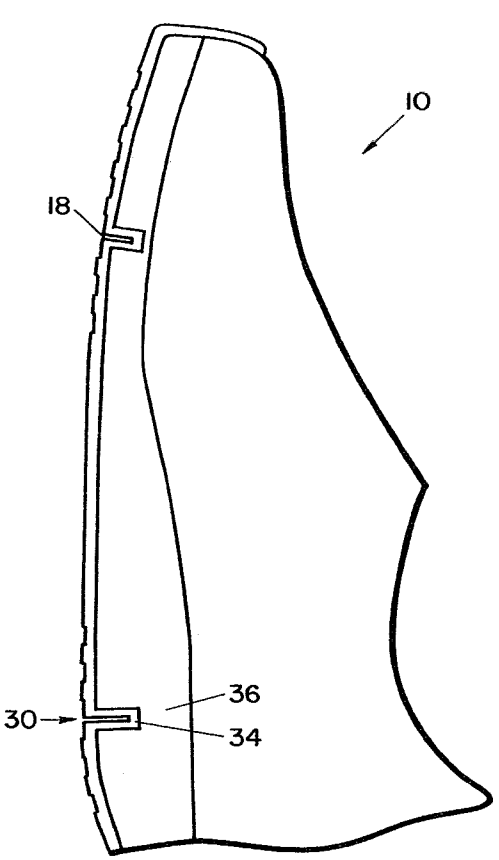
FIG. 3 is a profile view of an alternative embodiment illustrating a rearfoot hinge joint in addition to the forefoot hinge joint.

The foregoing type of construction can be employed not only at the ball of the foot but wherever a hinge joint is required or desired. For instance, it can be used to provide a transverse hinge joint 30 in the anterior heel region of the sole. The rearfoot hinge joint 30 is illustrated in profile detail in FIG. 3. Hinge joint 30 is received in groove 34 and relieves longitudinal sole stiffness between the heel and the shank, permitting a more gentle heel landing.

The forefoot hinge joint 18, as previously described, should be constructed to allow easy longitudinal bending of the sole at that location. Accordingly, the thickness of the midsole 14 above the identation 22 should be relatively thin. By contrast, in heel region 36, the thickness of the midsole 14 above the joint 30 should be moderately thick to allow moderate resistance against bending at that location.

Generally hinge joints are desirable on shoes having relatively inflexible soles because the foot does not flex naturally and comfortably in such an environment.

According to the preferred embodiment hinge joints 18 and 30 are straight like door hinges. If the sole is stiff near a joint, then the joint should be straight to avoid excessive stress on it. On the other hand, if a region of the sole is fairly flexible, then a joint in that region may be curved. For example, a joint 30 at the ball of the foot, instead of being straight, might follow a curved line which passes under all five metatarso-phlangeal joints. If the sole is stiff near a hinge joint in the ball region of the foot, then the joint should be not only straight but also transverse. If the joint were oblique rather than transverse, it would assist the foot in bending obliquely rather than longitudinally. On the other hand, if the sole is generally flexible near a hinge joint 30 in the ball region, then the orientation of the joint is not particularly important.

The orientation of a hinge joint 30 in the heel region is preferably substantially transverse to the long axis of the sole. Supination is mildly encouraged if the medial extremity of the joint is somewhat farther forward than the lateral extremity, while pronation is mildly encouraged in the reverse instance. To achieve one of these effects, the angle of obliqueness (with respect to a line perpendicular or transverse to the major axis of the sole) might be about plus or minus 10°, although the effect depends greatly upon the compressibility of the sole and the mechanics of landing.

Although the hinge joint construction has been described with respect to running shoes, the method and principals can be applied to other types of shoes as well. In all cases, it is recommended that the outer soles be molded of a strong material, such as a hard-wearing rubber or plastic. In shoes having spikes, for instance, golf shoes, fittings are installed in the usual fashion, but do not extend into the joint region.

Figure 5:
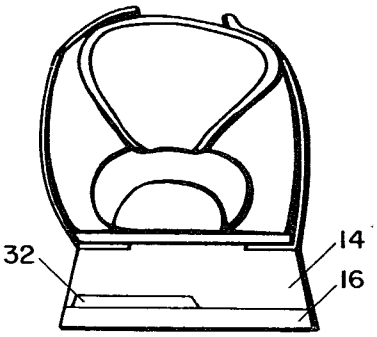
FIG. 5 is a cross-sectional view of a right foot shoe including a medial shank stiffener therein.

For most purposes the shoe of this invention will include a heel lift. The heel lift offers several benefits, and many adults require elevated heels because they had them in childhood. However, heel elevation decreases rearfoot stability. Since the foot pronates after landing, it is advisable to incorporate a pronation stabilizing feature in a shoe having a heel lift. Accordingly, it is the recommendation of this disclosure that the shoe sole be fairly wide in the shank region and include a medial longitudinal shank stiffener 32. A cushioned arch-supporting insole or inlay is preferably included in the shoe. A detailed description of acceptable shank stiffening methods may be found in my copending patent application entitled "AN ATHLETIC SHOE INCLUDING STIFFENING MEANS FOR SUPPORTING THE REAR PORTION OF THE FIRST METATARSAL BONE", U.S. Ser. No. 134,651 filed on Mar. 27, 1980 and which is incorporated herein by reference in its entirety. FIGS. 4 and 5 of the present invention illustrate a shank stiffening technique described in my copending application with the exception that the forefoot hinge joint 18 illustrated in FIG. 4 is not found in that copending disclosure. Other medial shank stiffening techniques also disclosed in my copending application may be employed with the articulated sole of the present invention.

While the foregoing invention has been described with reference to the preferred embodiment, it will be appreciated by those of ordinary skill in the art that various different parts that comprise the invention may be altered, modified or substituted without departing from the spirit and scope of the invention.

I claim:

1. An athletic shoe comprising:

an upper;

a resilient sole attached to said upper, said sole comprising at least a first and a second portion capable of substantially independent rotational movement with respect to each other;

a first hinge means for connecting said first and second portions together, said first hinge means extending continuously across the width of said sole and passing substantially under the first metarsophlangeal joint of the foot, said first portion of said sole extending forwardly of said first hinge means and said second portion extending rearwardly of said first hinge means;

a second hinge means extending continuously across the width of said sole in the location of the anterior heel region, thereby defining a third portion of said sole rearwardly of said second hinge means; and, an outer sole included in said sole, said outer sole extending continuously through said first and second hinge means, wherein the thickness of said sole above said first hinge means is thinner than the thickness of said sole above said second hinge means so that said first hinge means is more flexible than said second hinge means.

2. An athletic shoe comprising:

an upper;

a resilient sole attached to said upper, said sole comprising at least a first and a second portion capable of substantially independent rotational movement with respect to each other;

a first hinge means for connecting said first and said second portions together, said first hinge means extending continuously across the width of said sole and passing substantially under the first metarso-phlangeal joint of the foot, said first portion of said sole extending forwardly of said first hinge means and said second portion of said sole extending rearwardly of said first hinge means; and, a second hinge means extending continuously across the width of said sole in the location of the anterior heel region, thereby defining a third portion of said sole extending rearwardly of said second hinge means, wherein said second portion of said sole located between said first hinge means and said second hinge means is relatively stiff and inflexible compared to said first and third portions of said sole.

* * * * *